United States Patent [19]

Swartz

[11] Patent Number: 4,971,332

[45] Date of Patent: Nov. 20, 1990

[54] BOARD GAME

[76] Inventor: Elmer L. Swartz, 9490 Harbor Greens Warf C-203, Seminole, Fla. 34646

[21] Appl. No.: 324,274

[22] Filed: Mar. 15, 1989

Related U.S. Application Data

[63] Continuation-in-part of Ser. No. 202,415, Jun. 6, 1988, Pat. No. 4,915,392.

[51] Int. Cl.[5] ..... A63F 3/00

[52] U.S. Cl. ..... 273/258; D21/35

[58] Field of Search ..... 273/258, 249, 248, 243, 273/272; D21/35

[56] References Cited

U.S. PATENT DOCUMENTS

| | | | |
|---|---|---|---|
| D. 188,676 | 8/1960 | Nelson | D21/35 |
| D. 261,015 | 9/1981 | Siedun | D21/35 |
| 977,485 | 12/1910 | Tercy | 273/258 |
| 1,692,519 | 11/1928 | Spilling | 273/248 |
| 4,252,320 | 2/1981 | Rouse | 273/243 |
| 4,416,455 | 11/1983 | Munson et al. | 273/272 |
| 4,895,375 | 1/1990 | Blitz et al. | 273/258 |

*Primary Examiner*—Benjamin Layno

*Attorney, Agent, or Firm*—Charles E. Lykes, Jr.

[57] ABSTRACT

An improved apparatus for a game, the apparatus generally comprising a game board having concentric ring paths which intersect with radial paths. The intersections represent spaces for the placement and movement of playing pieces. Each player is assigned a group of playing pieces. The playing pieces are identical in shape and are only distinguish by color wherein one player's playing pieces are of one color and the other player's playing pieces are of a different color. In addition, a sufficient number of neutral color playing pieces are also provided. To start play, all the playing pieces are placed in a grab bag. Beginning with any starting position concentric ring, players alternate, randomly drawing playing pieces from the grab bag. The first piece is placed at the starting position and the successively drawn pieces are placed one at a time around the concentric ring on successive spaces either clockwise or counter-clockwise from the starting position. When all the playing pieces have been drawn and placed on the board, the players in turn, move their playing pieces towards the designated finishing spaces near the center of the board.

4 Claims, 4 Drawing Sheets

BOARD GAME

This a continuation in part with the inventor's patent application Ser. No. 07/202,415 Elmer Swarte on Jun. 6, 1988, now issued as U.S. Pat No. 4,915,392 which is fully incorporated herein.

In the inventor's patent application Ser. No. 07/202,415, the inventor teaches a board game entitled "Checkout". The board game generally comprises a series of concentric circles with a variety of paths towards the innermost concentric circle. The points at which such paths intercept with the concentric circles are numbered playing positions. Each player is given a set number of beginning playing positions upon which the player sets his respective playing pieces. The object of the game is for each player to move his playing pieces towards destination playing positions which are regularly positioned about the innermost concentric circle.

In order to play the game "Checkout" in its present form, it is necessary for each of the playing positions to be assigned a specific designation and for each of the playing pieces to be marked correspondingly. This must be done to ensure random assignment of the beginning positions.

While the marking of each playing position and corresponding marking of each playing piece facilitates the playing of an interesting and unique game, the existence of such numerous labelling of the game board and the playing pieces both complicates both the manufacture of the game apparatus and makes the initial set up of the game board for play somewhat time consuming. It would be useful to devise a method and apparatus for simplifying the manufacture of the game as well as the task of setting up the game board for play.

SUMMARY OF THE INVENTION

The inventor has refined his game in order to solve the problems described above. In order to avoid the need to label each individual playing position as well as each individual playing piece and still accomplish random assignment of playing positions, the inventor has fashioned a revised design for the playing board, the playing pieces, and the method of setting up the game for play. The invention generally comprises an improved game board in which it is nesessary to label only playing position in each starting position concentric ring. It further comprises a set of game pieces which are not individually marked with a starting position, but are rather provided in the following manner. A sufficient number of two different colors of playing pieces are provided to ensure that each player has an adequate number to begin play. In addition, a sufficient number of neutral color of playing pieces are provided in order to accomplish the task of leaving enough open playing positions to allow each player to begin movement.

In patent application Ser. No. 07/202,415 a means of starting play required each player to select a marked playing piece and place the playing piece on the assigned playing position with that player's color up. When each player had drawn a sufficient number of playing pieces there would be an equal number of each player's playing pieces on the board and the desired number of open places would exist to begin playing.

In the improved version of the game each player counts the exact number of desired starting playing pieces of his color into the grab bag. Then the number of neutral pieces corresponding with the desired number of beginning open spaces is placed into the grab bag.

Beginning with any starting position concentric ring the players alternate drawing playing pieces from the grab bag.

Starting at the marked playing position for each concentric ring, each player alternately draws randomly a playing piece from the grab bag and puts the piece on the board on that concentric ring, moving either clockwise or counter-clockwise from the marked position on that particular concentric ring. When all the playing pieces have been drawn from the grab bag all of the playing positions will be filled and each player will have an equal number of playing positions marked with his color on the board. The neutrally colored playing positions will also be on the board. At this time, the neutrally colored playing pieces may be removed from the board and the game is ready for play.

This apparatus and method has the advantage of making faster the method of assigning playing pieces. Additionally it saves the player from having to ensure that the playing piece is set up on the game board with the right color up. Additionally, if the playing piece were to fall over during the play of the game there would not be confusion as to which player's piece it was, as the possibility for inadvertant rotation to the wrong color would have disappeared.

While this improved apparatus and method has the advantage of still ensuring that each player begins the game with randomly assigned specific playing positions, it can be seen that the tasks of both manufacturer and game board set up have been greatly simplified.

It is an object of the invention to provide a simplified apparatus for playing the game board "Checkout". It is a further object of the invention to provide a simplified apparatus which incorporates unmarked playing pieces and a minimally marked game board.

It is a further object of the invention to provide a simplified method of setting up the game board "Checkout" for play without the need to orient each playing piece with respect to player identity nor to search the game board for an individual playing position.

Other features and advantages of the present invention will be apparent from the following description in which the preferred embodiments have been set forth in conjunction with the accompanying drawings.

Exhibit 1 is a version of the rules for playing the game "Checkout" according to the improved embodiment.

DETAILED DESCRIPTION OF THE DETAILED EMBODIMENT

In describing the preferred embodiment of the invention reference will be made to the above described figures and exhibit together with those of the patent application Ser. No. 7/202,415, filed by Elmer Swartz on Jun. 6, 1988, which is fully incorporated by this reference.

Making reference first to FIG. 7, it can be seen that a playing piece (50) according to the improved version of the invention requires no markings. It is only necessary to supply an adequate number of each separately colored playing piece (50) to correspond with its function. For instance, reference is now made to FIG. 8, which depicts a game board with forty beginning spaces and eight objective spaces (61). It is desired that for these beginning spaces (60) there will be sixteen assigned to player one, sixteen assigned to player two, and eight open spaces which exist in order to facilitate the opening moves of the game.

Figure 1:
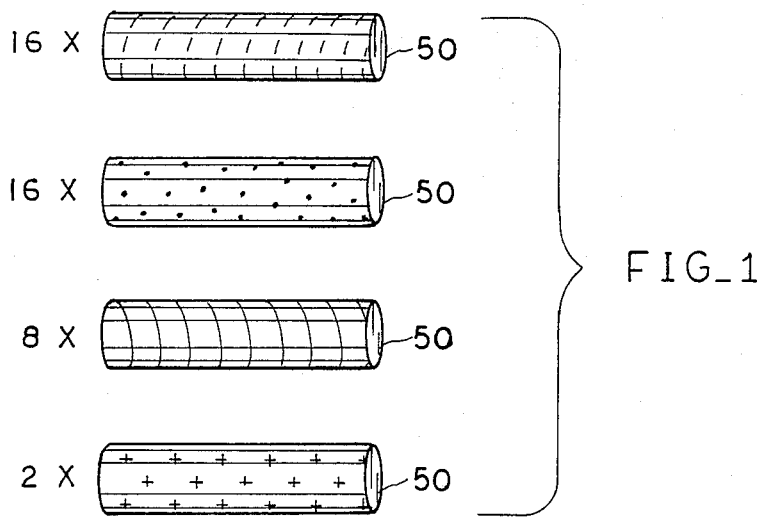
FIG. 1 is a depiction of a playing piece under the improved version of the game.
Figure 2:
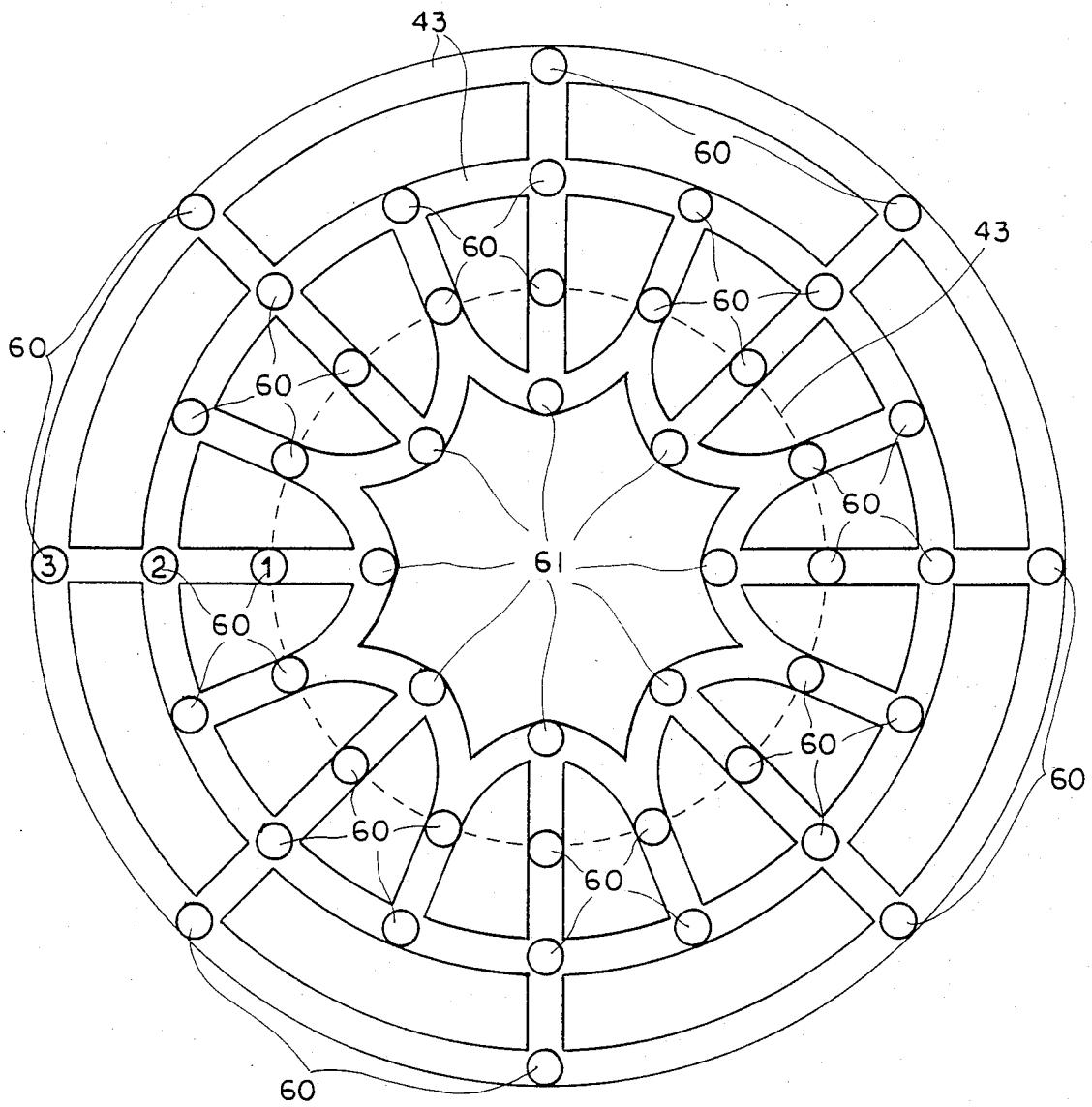
FIG. 2 is a depiction of the playing area depicting the simplified markings required for the game board under the revised version of the game.
Figure 3:
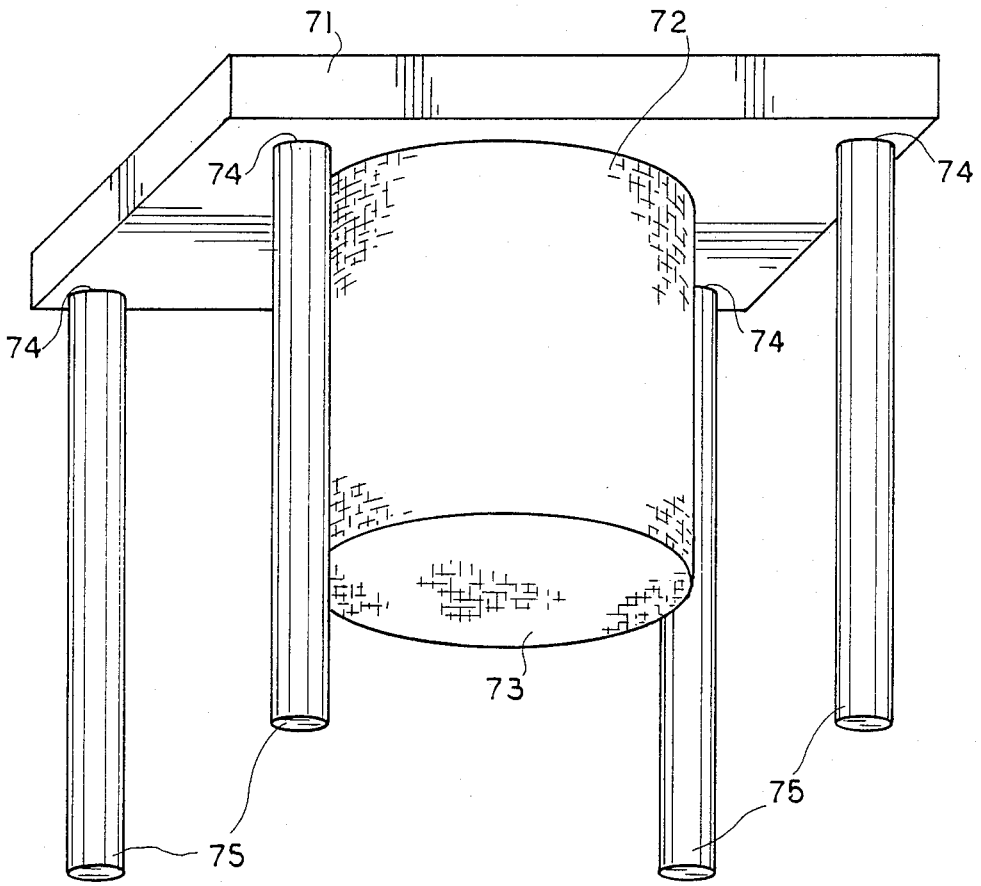
FIG. 3 is a depiction of an improved grab bag apparatus.
Figure 4:
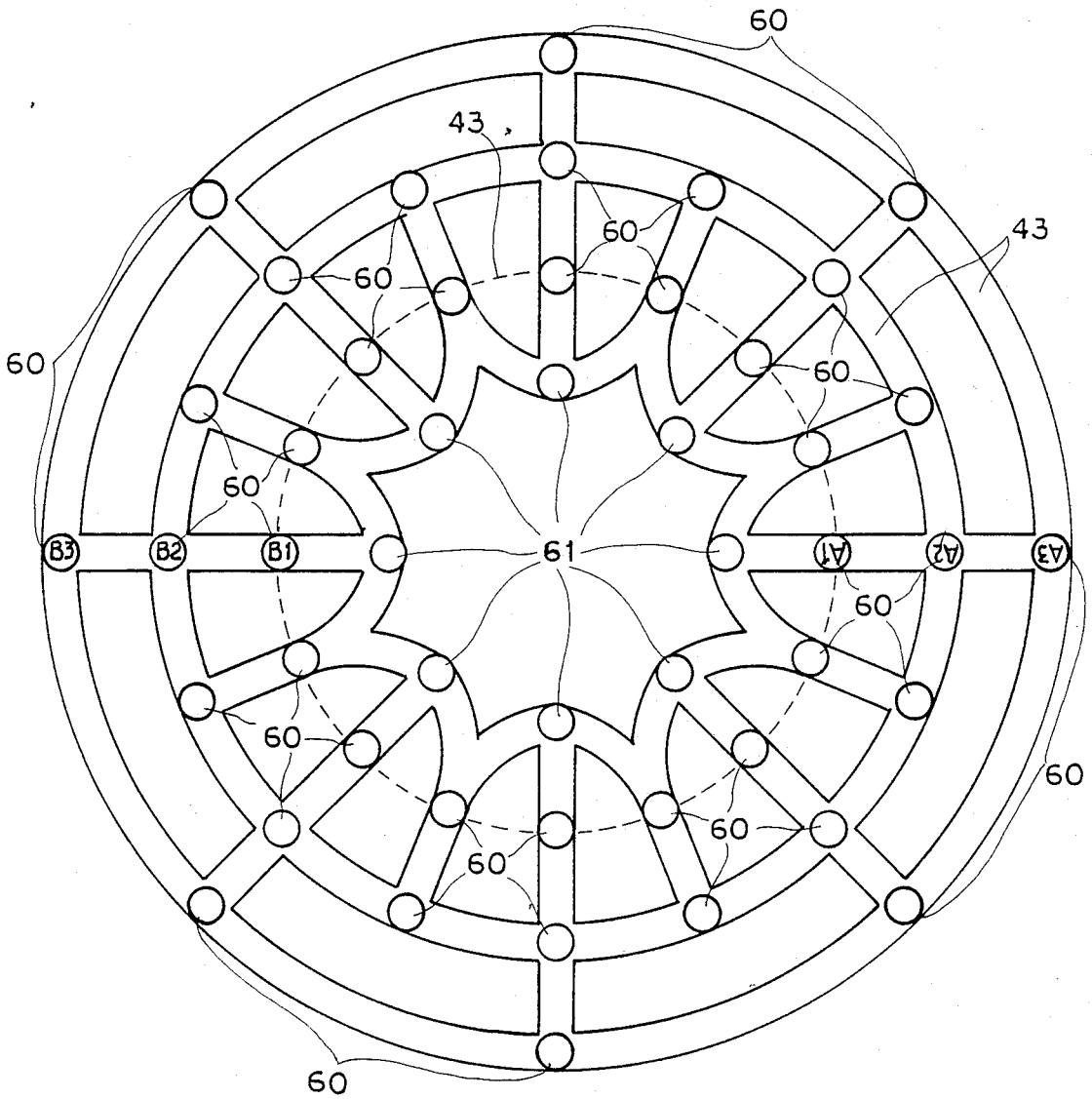
FIG. 4 is a depiction of a modification of the game board of the preferred embodiment.

Making reference now to FIG. 9, an improved grab bag apparatus is depicted. The new grab bag apparatus (FIG. 3) is designed to facilitate its storage in a game box (not depicted) for marketing the device. It comprises a rigid frame (71) adapted with an opening (72) in which a pliable bag (73) had been mounted. The frame (71) is further adapted with four notches (at 74) into which legs (75) may be inserted. This permits the pliable bag (73) to be suspended thereunder for mixing and drawing the playing pieces (not depicted in FIG. 3). After the grab bag apparatus (FIG. 3) has been used, the legs (75) can be removed from the notches (at 74) and the entire apparatus may be easily placed in a box.

In order to begin play, player one inserts into the grab bag sixteen playing pieces which are of player one's color. Player two inserts sixteen playing pieces which are of player two's color. Then a number of neutrally colored pieces are inserted into the bag to correspond with the number of open spaces desired to begin play, in this case eight.

Player one then reaches into the grab bag and removes any playing piece. Player one the places this playing piece upon the game board at the marked position of any marked concentric ring (43). Player two then reaches into the grab bag (23) and picks any player piece (50) and places it on the game board in the next starting space, (60) either clockwise or counter-clockwise, from the first position's piece. The players alternate until all the spaces on that concentric ring have been filled. Then another concentric ring (43) is filled until all the beginning spaces (60) are filled and the playing pieces (50) in the grab bag (73) have all been used. Then the neutral pieces (50) are removed and play may commence according to the rules of the game.

As described in the inventor's patent application, Ser. No. 07/202,415, as well as the game rules (Exhibit I) there may additionally be one or more separately colored "blockade" pieces assigned to each player.

While, just as in the inventor's patent application, Ser. No. 07/202,415 each player begins play from randomly assigned specific playing positions (60) and there are sufficient open spaces (60) to facilitate a first move from each player, this task is herein accomplished without the need to mark each playing piece and to mark each starting playing position. Both the manufacture of the apparatus and the initial set up of the game board for play have thus been substantially simplified.

One likely modification of the preferred embodiment is outlined in Exhibit I, and depicted in FIG. 10 10, which is fully incorporated by this reference. Rather than having only one marked place (61) in each starting concentric ring (60), two such marked spaces (62), which are situated at opposite sides of each starting concentric ring (60) and situated to define a nearest one half of the playing board (63) for each player. Then each player fills each half of the player's ring by drawing pieces (50) from the bag (73) randomly and moving about that player's half (63) of the ring.

Modification and variation can be made to the disclosed embodiments without departing from the subject and spirit of the invention as defined in the following claims. Such modifications and variations, as included within the scope of these claims, are meant to be considered part of the invention as described.

EXHIBIT I

The Checkout Game

CHECKOUT is a stratgy game for 2 people. The rules are easy. Adults and children down to 9 years of age can play.

The game consists of a board, a scramble bag and 2 red, 8 black, 16 yellow and 16 green playing pieces.

Insert the 4 legs into the scramble frame and you are ready to play CHECKOUT.

HOW TO PLAY CHECKOUT

Each player plays the pieces of the same color as his CHECKOUT row and the first to fill his row is the winner.

1. Place 1 red piece on each blockade spot and all other pieces are placed in the scramble bag and mixed.

2. Each player reaches in the bag and takes one piece and places it on his starting spot indicated as A1 and B1. Continue taking out one pieces at a time and placing it on the next spot in a counter clockwise pattern. After placing 8 pieces you must go to "2" of your starting positions and continue for 8 more, then to "3" for 4 more pieces. Remove the 8 black pieces from the board and put them back in the scramble bag. You are now ready to play.

3. The first destination for the pieces are the star spots. Decide who goes first.

4. Move one spot in any direction but always follow a blue path.

5. You may make 1 jump per move on any straight or curved path but not around sharp corners. Place the jumped piece in the captured row which allows for a total of 5.

6. Anytime, before you move, you may place your blockade on any empty spot or replace your opponents piece with it and it does not count as a move. The blockade sits on that spot for the remainder of the game and the captured piece must be placed in you captured row.

7. Your piece landing on star spot can be moved to the CHECKOUT row for your next move. You may leave it for blocking purposes, but it can be captured.

8. When it's your turn you have 1 or more pieces on the star spots and all 8 spots are occupied then you must for your next move, remove 1 of your pieces and place it in your CHECKOUT ROW.

Alternate moves until 1 player has filled his CHECKOUT row and wins. The loser goes first the next game.

STRATEGY:

Blocking 2 or 3 pieces with one of yours is a good move. Jumping your opponent and landing on a star spot is usually a good move. Try to move only pieces that you think will make it to the CHECKOUT row. A key play is to make good use of the blockade. There are other trick moves and selecting the best move will come with experience. Every game is different.

"The more you play the better you play".

What is claimed is:

1. A simplified apparatus for playing the board game "Checkout" further comprising;

a board which is marked with a pattern for maneuver, said maneuver pattern further comprising three or more concentric rings, the innermost of which is marked at regular intervals with four or more points around its circumference and one or more of the other said concentric rings being connected by a marked circular path;

three diverging paths extending radially out from each said innermost ring point such that one said diverging path extends directly out along the radius of said concentric rings from each said innermost ring point through the other said concentric rings with the other two surrounding diverging paths extending out from each said innermost ring point to one or more other said concentric rings in curved or oblique paths and such that each said curved or oblique path joins with the said curved or oblique path from an adjacent said innermost ring point at another said concentric ring and from said other concentric ring merge together and terminate or alternatively form a common path which extends generally radially outward from said other concentric ring through at least one said surrounding concentric ring;

said innermost ring points being unmarked;

at least one playing piece for each said point of intersection, said playing piece being distributed as follows, an equal number of playing pieces in each of two colors or with each of two specific designs in a number sufficient to place one each upon a substantial number of starting positions and other unmarked or separately colored playing pieces in a number sufficient to place one each upon the remaining said starting positions, each said playing piece further adapted to rest upon any said point of intersection or any said innermost ring point;

two additional said playing pieces which are of any color and unlabeled and are further adapted to rest upon any said point of intersection or any said innermost ring point; and containing a mixing chamber into which each said playing piece may be enclosed and thoroughly mixed together and from which said mixed playing pieces may be randomly distributed.

2. The invention described in claim 1 in which there are two starting positions in each starting concentric ring which are on opposite sides of said concentric ring.

3. The invention described in claim 1 in which said mixing apparatus further comprises a pliable bag, the opening of which is mounted within the opening of rigid frame, said rigid frame being further adapted with 3 or more notches, said notches being adapted to receive 3 or more legs of equal length such that said legs extend out generally perpendicular to the plane of said rigid frame opening, said leg length being adequate to permit the suspension of said pliable bag.

4. The invention described in claim 2 in which said mixing apparatus further comprises a pliable bag, the opening of which is mounted within the opening of a rigid frame, said rigid frame being further adapted with 3 or more notches, said notches being adapted to receive 3 or more legs of equal length such that said legs extend out generally perpendicular to the plane of said rigid frame opening, said leg length being adequate to permit the suspension of said pliable bag.

* * * * *